US005959230A

United States Patent [19]

Fulford

[11] Patent Number: 5,959,230

[45] Date of Patent: Sep. 28, 1999

[54] TACTILE TEMPO INDICATING DEVICE

[76] Inventor: Scott L. Fulford, 740 Franklin St., Denver, Colo. 80218

[21] Appl. No.: 09/197,381

[22] Filed: Nov. 20, 1998

[51] Int. Cl.[6] ..... A63J 17/00

[52] U.S. Cl. ..... 84/464 R; 84/484

[58] Field of Search ..... 84/484, 464 R, 84/464 A, 470 R, 477 R

[56] References Cited

U.S. PATENT DOCUMENTS 4,437,381 3/1984 Chen ..... 84/477 R X
5,689,077 11/1997 Jasinski .
5,743,744 4/1998 Cassily et al. .

*Primary Examiner*—Jeffrey W. Donels

[57] ABSTRACT

This device uses two solenoids to create a steady, tactile pulse. This pulse conveys a specific beat to the user and therefore conveys tempo in the manner of a metronome. A tempo-signal generating circuit feeds electric pulses to a "t" flip-flop. This flip-flop changes state with each pulse and through relays turns on or off the solenoids. The solenoids are spring loaded and return to place when power is off. This causes a jerk which is conveyed to the user through a belt clip, neck strap, or directly through the wall of the solenoid containing case. By using this invention, time may be kept in a precise manner without the intrusion of light or sound that occurs with other metronomes.

18 Claims, 3 Drawing Sheets

TACTILE TEMPO INDICATING DEVICE

FIELD OF INVENTION

This invention relates to devices that indicate tempo or time such as metronomes.

BACKGROUND OF THE INVENTION

Metronomes have been around for almost 200 years. The first metronomes were mechanical with a baton that swung back and forth and produced a click. Purely mechanical (non-electrical) metronomes tend to be expensive and capricious. Clockworks are difficult to produce and can easily age and deteriorate. Mechanical metronomes also require periodic winding which can be a distraction and an annoyance. The problems with mechanical metronomes led to the more recent development of electronic metronomes.

Electronic metronomes use electricity to drive a motor to swing the baton instead of clock works, or they produce a tone or light to indicate the beat. The only improvement the electromechanical metronomes offer over the older types is an end to winding and an increase in accuracy. Purely electronic metronomes also have their detractions. Blinking lights are a distraction when attempting to play an instrument and are not especially useful for keeping time. The tone produced is often loud and piercing. This makes them aggravating to the musician.

All metronomes (electrical or mechanical) that produce noise have a limitation: since music is an audible medium, the noise made by the metronome intrudes upon and diminishes the enjoyment of the music being played. Sound-producing metronomes detract from the very thing they are meant to enhance. Neither musician nor a possible audience can fully enjoy the music because of the external, non-musical noise.

SUMMARY OF THE INVENTION

Accordingly, this invention poses several advantages. By using a non-audible means to convey the tempo, it does not distract and annoy either musician or a possible audience which need not be even aware of its presence. Few musicians actually perform with conventional metronomes for the reason that they are distracting and are readily seen or heard, but a metronome that can produce a jerk strong enough to be felt and produces negligible noise could be worn by a musician without alerting the audience or distracting from the music. A musician practicing with a metronome would also find many advantages. By using a tactile means of conveying the time it does not cause the eye strain that a flashing metronome might nor the distraction that a flashing light causes. A tactile metronome may aid a sight impaired musician. A tactile beat is also less intrusive then an audible click or tone. Feeling the beat may also help the musician stay in time because the tempo can become more internalized. Also, this device could be a great aid to hearing impaired musicians where the rhythm of an orchestra, choir performance or the like can be translated to the tactile output of devices constructed in accordance to this invention.

This invention is directed to the use of two opposing solenoids to create a jerking movement which conveys a predetermined tempo in a tactile, substantially noiseless manner.

Further objects and advantages of this invention will become apparent from a consideration of the following descriptions and of the drawings.

Reference Numerals Used in Drawings

| | | | |
|---|---|---|---|
| C1 | A circuit that generates predetermined time pulses | C2 | "T" (toggle) flip-flop |
| R1 | relay | R2 | relay |
| S1 | Solenoid | S2 | Solenoid |
| 12 | Solenoid body that contains coils (not shown) | 14 | rubber pad |
| 16 | spring | 18 | solenoid core |
| 20 | wall of case | 22 | wires |
| 24 | enclosing case | 26 | belt clip |
| 28 | alpha-numeric display | 30 | on/off switch |
| 32a | tempo control up | 32b | tempo contro down |
| 34 | Solenoid A | 36 | Solenoid B |
| 38 | electronic circuitry for producing signal | 40 | power supply |
| 42 | rubber pad for Solenoid B | 44 | rubber pad for Solenoid A |
| 46 | rubber pad for Solenoid A | 48 | rubber pad for Solenoid B |
| 50a | metal loop | 50b | metal loop |
| 52 | neck strap | | |
| C3 | A circuit that generates predetermined time pulses | C4 | solenoid driving circuit |
| C5 | solenoid driving circuit | L1 | LED or light source (possibly visible) |
| D1 | photodiode | D2 | photodiode |
| C6 | A circuit that generates predetermined time pulses | C7 | solenoid driving circuit |
| C8 | solenoid driving circuit | | |

DETAILED DESCRIPTION OF THE PREFERRED EMBODIMENT

Figure 3:
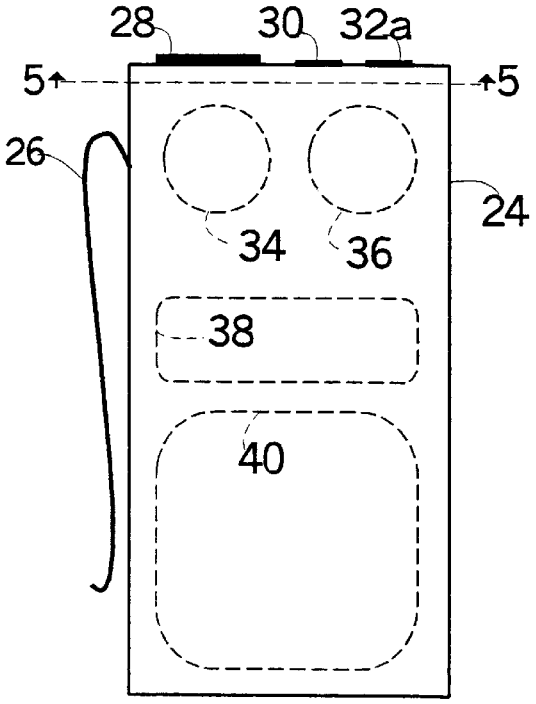
FIG. 3 shows a front view of the case of the preferred embodiment of this invention.
Figure 4:
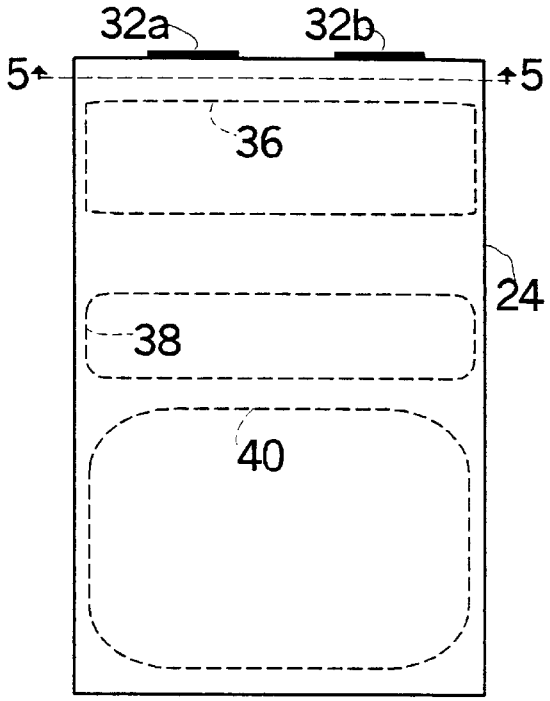
FIG. 4 shows a side view of the case of the preferred embodiment of this invention.

One embodiment of the tactile tempo indicating device according to this invention is illustrated in FIG. 3 (front view) and FIG. 4 (side view). To an enclosure 24 may be attached a belt clip 26, two metal loops 50*a* and 50*b* through which a neck strap 52 runs, an alpha-numeric readout display 28, and means for controlling the tempo 32*a* and 32*b* and an on/off switch 30. Within and at the top of the enclosure 24 two movable, or more specifically, reciprocating elements or solenoids 34 and 36 are placed lengthwise. Below the solenoids is placed the circuitry 38 which drives the solenoids and below that the power supply 40 that provides electricity to run the solenoids 34 and 36 and circuitry 38.

Figure 2A:
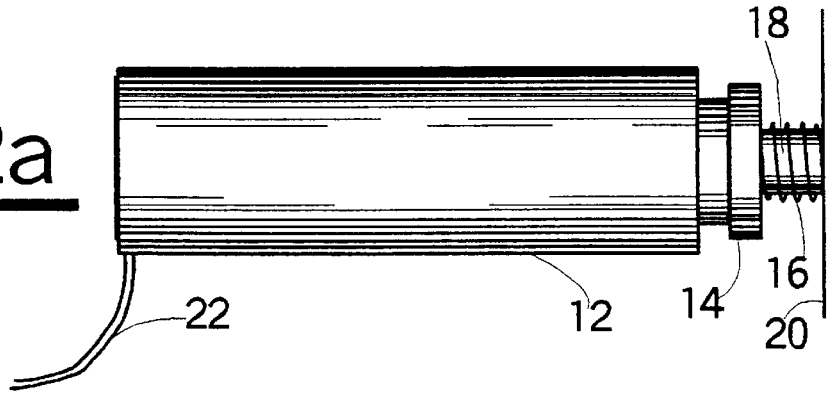
FIGS. 2*a* and 2*b* show one of the solenoids used to provide the tactile sensation with power applied (2*a*) and power absent (2*b*) respectively.
Figure 2B:
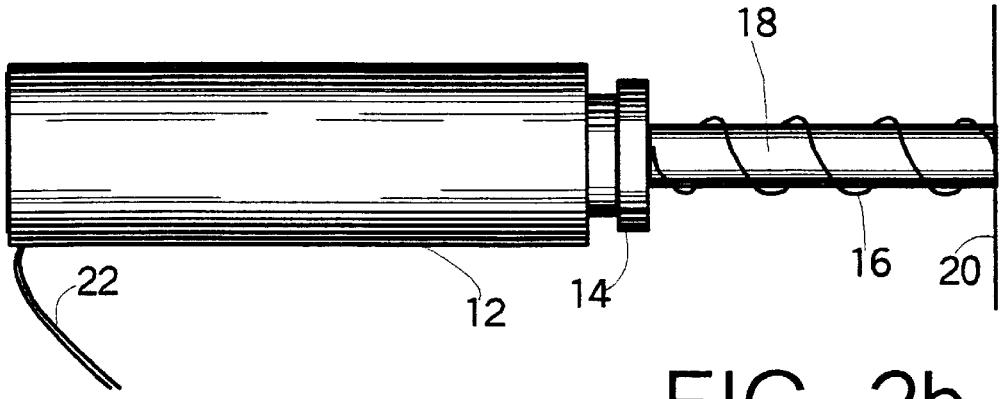

One of the solenoids is shown in FIGS. 2*a* and 2*b*. The figures illustrate a solenoid with power supplied in FIG. 2*a* and with power off in FIG. 2*b*. Wires 22 provide electricity to the solenoid. The case of the solenoid 12 encloses the coils through which the current runs, creating a magnetic field which draws the solenoid along its core 18. This core is bolted to the side wall 20 of the enclosure 24 shown in FIGS. 3, 4, and 5. The solenoid has no other fixed attachment to the rest of the device, except the power conducting wires 22, each of which have flexibility and lengths adequate to allow free movement of the solenoid body relative to its respective core 18. FIG. 2*a* shows the solenoid activated with its spring 16 contracted while FIG. 2*b* shows the solenoid in rest position with its spring 16 fully elongated. Rubber pad 14 is attached to the end of the solenoid and made of any noise-dampening material.

Figure 5:
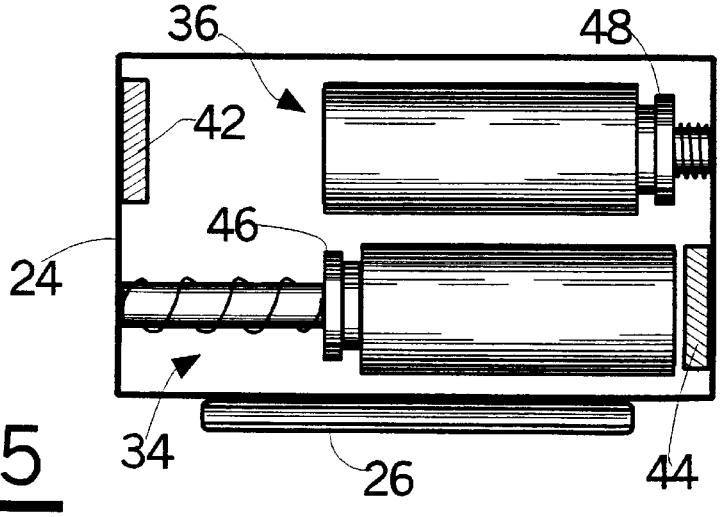
FIG. 5 is a sectional view along line 5—5 of FIG. 4 showing the two solenoids of this preferred embodiment operating.

A top view of the pair of solenoids while power is supplied (at the end of one pulse) is shown in FIG. 5. Solenoid 36 is powered while solenoid 34 is not. Rubber pads 42 and 44 are attached to the wall of the enclosure and are made of any material that decreases noise but does not detriment the power of the movement of the solenoids. Rubber pads 46 and 48 are made of a similar material and are attached to the ends of solenoids 36 and 34.

Figure 1:
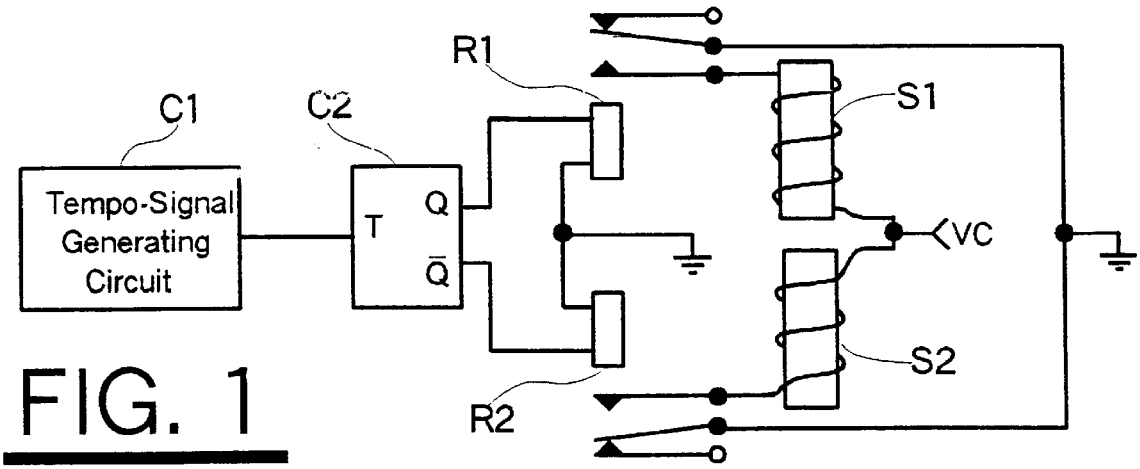
FIG. 1 is a schematic for the driving circuits of the preferred embodiment of this invention.

A circuitry diagram is provided in FIG. 1. A tempo signaling circuit C1 provides a pulse or signal at a predetermined rate. Circuit C2 is a toggle flip-flop. The flip-flop circuitry has adequate power output to drive Relays R1 and R2. Solenoids S1 and S2 may be any spring loaded solenoid with sufficient jerking or reciprocal moving power and of appropriate requirements (size, power consumption, voltage differential requirements). The solenoids and their driving circuitry produce the tactile beat.

Figure 6:
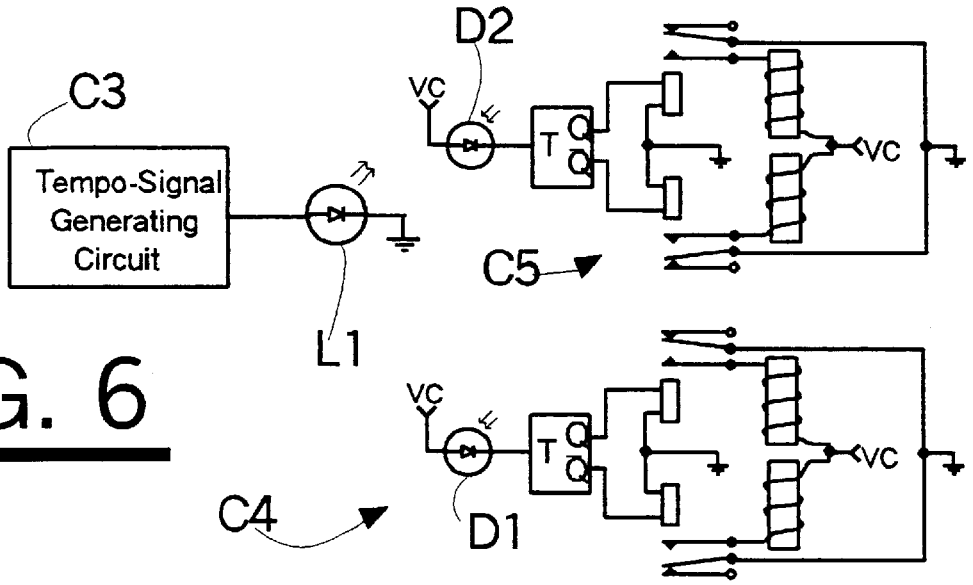
FIG. 6 and FIG. 7 show schematics of alternate possible embodiments.
Figure 7:
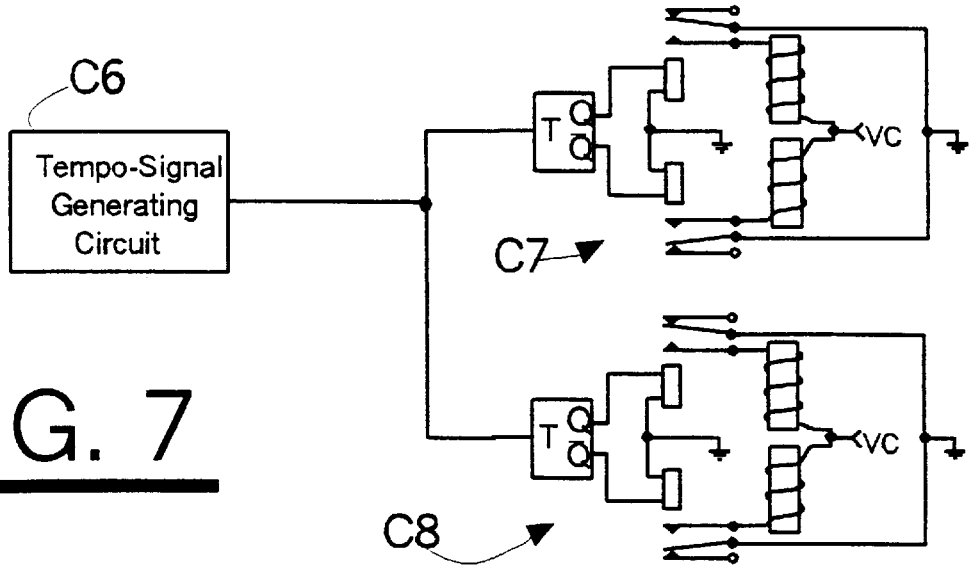

Two alternate embodiments are illustrated in FIGS. 6 and 7. These figures show one Tempo-Signal Generating Circuit controlling multiple tactile metronomes. The embodiment in FIG. 6 shows tempo signal generating circuit C3 which produces a pulse at a predetermined rate. Light emitting diode L1 produces a pulse of light (or another part of the electromagnetic spectrum including ultraviolet and radio waves). Diodes D1 and D2 are able to detect the light or other pulse sent out by L1. C4 and C5 are circuits showing the part of this embodiment which makes the beat felt—that is the solenoids and the driving circuitry for them similar to that shown in the previous figures. The embodiment shown in FIG. 7 shows one pulse generator C6 controlling multiple solenoid and circuitry assemblies through hard wiring (actual wires that connect the different parts). C7 and C8 are circuits similar to the previous embodiments including solenoids and driving components to make the tactile beat as described above.

The operation of the preferred embodiment will now be described with reference to FIGS. 1 through 5. When a pulse is supplied from Tempo-signal generating circuit C1 to T flip-flop C2, flip-flop C2 changes state. One of its outputs changes from on to off and the other from off to on. This turns off one relay and turns on the other. The relays R1 and R2 in turn cut off power to one solenoid while supplying it to the other. The solenoids at this point are shown in FIG. 5. As solenoid 36 loses power, its spring pushes it back where it hits pad 42. At the same time and in the same direction solenoid 34 receives power and pulls itself in, compressing its spring. Solenoid 34 soon has gone as far as it can and its pad 46 stops it in a substantially noiseless manner. This movement of mass causes the entire device to jerk in one direction. This movement is conveyed to the user through the enclosure 24 when the user is using belt clip 26 or has the device around his or her neck via the neck strap 52. The tempo-signal generating circuit C1 then produces another pulse which causes flip-flop C2 to change state again, setting the process over again with solenoid 36 powered and solenoid 34 being pushed back by its spring. The two solenoids are placed opposing each other so that when one is powered and is pulling itself along its core the other is being pushed back in the same direction by its spring. This means that both solenoids are adding to the power of the pulse even though only one is powered.

FIGS. 2*a* and 2*b* show the workings of the solenoids as they move back and forth or reciprocally. These figures each show a close up of one of the solenoids. In FIG. 2*a* wires 22 are bringing current to the solenoid case 12 which holds the coils of a solenoid. This causes the solenoid to pull itself along its core 18 compressing the spring 16 and coming closer to the wail of the case 20. Rubber pad 14 decreases any noise that may result from this action which occurs very quickly. FIG. 2*b* shows the solenoid without power. Its spring 16 has fully extended it out from wall 20 along its shaft 18.

The rate at which the tempo-signal generating circuit C1 produces pulses is determined by pressing switches 32*a* and 32*b* and the beats per minute is displayed on numerical display 28 which in turn is operated by conventional additional circuitry that is not shown. Conventional power supply 40 powers the rest of the invention.

In the alternate embodiment shown in FIG. 6, a tempo-signal generating circuit C3 controls a multiple metronomes C4 and C5 by flashing a LED L1. The pulses from LED L1 are picked up by photodiodes D1 and D2 which translate them into pulses to control their respective tactile metronome units C4 and C5, each of which is constructed in accordance with my invention.

In the further alternate embodiment shown in FIG. 7, a tempo-signal generating circuit C6 supplies pulses through wires to multiple metronomes C7 and C8. These then work in tandem because they are receiving the same pulse. Although the operation has been directed to the use of a solenoid to produce a jerking movement it is understood that another moving element could also be used as long as the movement of the element can be tactally conveyed to the user.

Construction of a Working Model

The following is a description of the parts and construction of a working model that uses only one solenoid and has two separate enclosures connected by a wire. The first enclosure is made of molded plastic with an aluminum top 5 1/16×2 5/6×1 5/8" in size, Radio Shack Number (RS#) 270-233. Protruding from this case is one big on/off switch (RS# 275-690) and three smaller SPST lever switches (RS# 275-690) which control how the beat is conveyed: through a LED (RS# 276-066 and standard snap in holder RS# 276-079) which is in a hole drilled through the side of the enclosure; through a piezo buzzer (RS# 273-059); or to a relay (Aromat RSD-5v AE564908 obtained through All Electronics a mail order firm). The relay conveys the beat through a 5.5 mm outside diameter, 2.5 mm inside diameter jack (RS# 274-1576), through a wire into the other enclosure (4 3/4×2 9/16× 1 9/16" RS# 270-222) and to the solenoid in that enclosure. The solenoid was pulled from parts by Gateway Electronics, an electronics store in Denver, Colo. It is a 12 v spring mounted solenoid with a bracket coming out of the core. The bracket is glued to the inside of the enclosure so that the body of the solenoid is not touching the case. Pieces of rubber bands were glued to the solenoid where it hits itself to decrease noise. The solenoid is powered by 8 AAA Duracell batteries in 4 holders (RS# 270-398). The batteries and the holders are inside the enclosure with the solenoid and power the solenoid when the relay is on. The enclosure containing the solenoid has a belt clip and a neck strap attached to its outside.

The relay, the buzzer and the LED in the other enclosure are all powered by a 9 v Duracell battery secured in the case by a battery clip (RS# 270-326) and a snap connector to its terminals (RS# 270-325). The 9 v battery is taken down to 6 v by a +6 v voltage regulator 7806 (RS# RSU 11392008) and then to 5.4 by a reversed diode 1N4001 (RS# 276-1101). A. 1 $\mu$f ceramic disc capacitor (RS# 272-135) decreases surges. The following come together to create a repeating, regular, pulse: a 555 timer (RS# 276-1723) with a 10 $\mu$f capacitor (RS# 272-1013); a 100 kΩ Potentiometer that sticks out from the enclosure (RS# 271-092) and a 15 kΩ resistor (4.7 kΩ+10 kΩ) to make the timer adjust in the correct range (approximately 35–240 beats per minute); and a 1 kΩ resistor to give the correct delay. This pulse is sent to a 7493 Binary Counter (from Gateway Electronics) that is modified to act like a T Flip-Flop. This in turn flips on for one pulse from the 555 timer and off for another, turning on and off a 2N222A NPN transistor (RS# RSU 11328507) which switches on or off the LED, the buzzer or the relay. All of these are attached to a PC board (part of RS# 276-150) and soldered in place. The two IC's are in IC sockets (All Electronics ICS-8 and ICS-14). The parts are connected by copper on the PC board or by insulated wire (less than 20 gauge, both stranded and solid). The binary counter could be connected to a second solenoid to pulse that solenoid in a manner consistent with the preferred embodiment shown in the figures.

This invention allows a musician or anyone else requiring a steady predetermined beat to keep a steady time without the annoyance of an audible or visual metronome. This invention does not use noise to convey the beat and so does not hinder the ability to enjoy the music, nor does it use light which can strain the eye and distract the musician. Instead it is felt, allowing the user to play in time and still enjoy the music and possibly to internalize the beat more effectively.

The description above contains specifics about the structure of one preferred embodiments and two other modifications to its use. These should not, however, be construed to limit this invention. Other variations are possible. For example only one solenoid may be used, or a different means of conveying a felt beat such as an electro-magnet may be employed. Other ways may be employed to control the solenoids or other tactile mechanism as well as to deaden noise such as air cushions or foam. The size or shape of the solenoids may be changed as well as their manner of operation. Other means, such as radio waves, may be used to transfer the signal generated by a single base tempo-signal generating circuit to other metronomes spatially distant from the base tempo-signal generating circuit. The invention may be suspended from the belt with the belt clip shown or from the neck or other means that allow the movement inside it to be conveyed to the body of the user. The tactile mechanism for conveying the beat may be combined with other methods (audible or visual) so that a user may select whether he or she wishes to see, hear, or feel the beat or any combination of the three. The circuitry shown may be modified or enhanced in different ways such as by the introduction of transistors to help boost the current of the "t" flip-flop allowing it to control the relays. This device is not limited to its use as a metronome for those playing or listening to music but may also be used by anyone requiring a steady beat, such as a dancer, or someone who merely wants a steady walking pace. It may also be used in conjunction with audible or visible for conveying tempo, to give the user choices, or to reinforce the beat. Also, devices according to this invention would be especially useful by musicians, dancers, and marchers and similar persons who are visually or hearing impaired.

Accordingly the scope of the invention should not be determined by the embodiments illustrated or described but by the claims and their legal equivalents.

I claim:

1. A device that conveys tempo in a tactile manner to a user, such as a musician, dancer, marcher or the like, comprising:

an enclosure;

means for producing a beat signal, means in the enclosure for producing a tactile beat in response to the means for producing a beat signal;

said means in the enclosure for producing a tactile beat comprising at least one solenoid attached to said enclosure, said solenoid moving in response to a beat signal produced by said means for producing a beat signal and whereby the movement of said solenoid causes the entire enclosure to jerk and whereby the jerking of the enclosure conveys tempo through a tactile beat; and means for conveying said tactile beat to a user.

2. The device of claim 1 further including a second solenoid moving in response to a beat signal produced by said means for producing a beat signal, said one solenoid and said second solenoid being placed in an opposing relationship to one another in a manner whereby said solenoids move together in the same direction to cause the entire enclosure to jerk and convey tempo through the tactile beat.

3. The device of claim 2 further including means for decreasing noise said solenoids produce when moving in response to said beat signal.

4. The device of claim 3 wherein said means for decreasing noise are rubber pads attached to the interior of said enclosure wherein said rubber pads contact the solenoids during movement.

5. A device according to claim 1 wherein said means to convey said tactile beat to said user includes a belt clip to attach the enclosure to the user.

6. A device according to claim 1 wherein said means to convey said tactile beat to said user includes a neck strap to attach the enclosure to the user.

7. A device according to claim 1 further including a second means for producing a tactile beat, and a second means for conveying said second beat to a second user, and means for connecting said means for producing said beat signal to said first means and said second means for producing a tactile beat in response to said beat signal, whereby said first user and said second user can sense said beat signal.

8. A device according to claim 7 wherein said means for connecting is a combination of a light emitting device and a member of the group consisting of photodiodes, photoresistors and other light sensitive valves sensitive to emissions of said light emitting device.

9. A device that conveys tempo in a tactile manner to the user, such as a musician, dancer, marcher or the like, comprising:

an enclosure;

a signal generating circuit for producing a beat signal; and a moving element in the enclosure moving to producing a tactile beat in response to the signal generating circuit for producing a beat signal said moving element in the enclosure for producing a tactile beat being attached to said enclosure, said moving element moving in response to a beat signal produced by said signal generating means and whereby the movement of said moving element causes the entire enclosure to jerk and whereby the jerking of the enclosure conveys tempo through a tactile beat; and means for conveying said tactile beat to a user through the enclosure.

10. A device according to claim 9 wherein said moving element includes at least one solenoid, said solenoid moving in response to a beat signal produced by said signal generating circuit for producing a beat signal.

11. The device of claim 10 further including a second solenoid moving in response to a beat signal produced by signal generating circuit for producing a beat signal, said one solenoid and said second solenoid being placed in an opposing relationship to one another whereby said solenoids move together in the same direction to cause the entire enclosure to jerk and convey tempo through the tactile beat.

12. The device of claim 11 further including rubber pads attached to the interior of the enclosure for contacting the solenoids during movement for decreasing noise said solenoids produce when moving in response to said beat signal.

13. A device according to claim 9 further including a belt clip to attach the enclosure to the user.

14. A device according to claim 9 further including a neck strap to attach the enclosure to the user.

15. A device according to claim 9 further comprising a second moving element for producing a tactile beat conveyed to a second user, and circuitry for connecting said signal generating circuit to said moving elements for producing a tactile beat in response to said beat signal, whereby said users can sense said beat signal.

16. A device according to claim 15 wherein said circuitry for connecting is a combination of a light emitting device and a member of the group consisting of photo diodes, photo resistors and other light sensitive valves sensitive to emissions of said light emitting device.

17. A device according to claim 15 wherein said moving elements are reciprocally moving elements.

18. The device of claim 12 wherein the solenoids are spring biased such that when each is not powered each solenoid is moved by the spring bias to an unpowered position.

* * * * *